US005083963A

United States Patent [19]

Lin

[11] Patent Number: 5,083,963

[45] Date of Patent: Jan. 28, 1992

[54] PINWHEEL

[76] Inventor: Chen-Hsiung Lin, No. 174, Ding Tan, Pi Tan Ts'un, Lu Tsao Hsiang, Chiayi Hsien, Taiwan

[21] Appl. No.: 655,597

[22] Filed: Feb. 15, 1991

[51] Int. Cl.[5] ..... A63H 33/40

[52] U.S. Cl. ..... 446/217

[58] Field of Search ..... 446/217, 218

[56] References Cited

U.S. PATENT DOCUMENTS

| | | | |
|---|---|---|---|
| 2,066,063 | 12/1936 | Walker | 446/217 X |
| 2,510,336 | 6/1950 | Donahue | 446/217 |
| 2,857,507 | 10/1958 | Stec | 446/217 X |
| 4,778,132 | 10/1988 | Stoecklin et al. | 446/217 X |

FOREIGN PATENT DOCUMENTS

| | | | |
|---|---|---|---|
| 1287151 | 8/1972 | United Kingdom | 446/218 |

*Primary Examiner*—Mickey Yu

*Attorney, Agent, or Firm*—Browdy and Neimark

[57] ABSTRACT

A pinwheel, which is related to a kind of toy resembling a windmill, particularly to which the blades or vanes are demountable for ease of storage or transpotation, utilizes a detachable cover having a plurality of pin members formed thereon to be inserted into respective through holes defined on each blade of the pinwheel and further encloses the cover by a sleeve provided with flange portion to confine the blades positioned on the cover. It further utilizes a decoration member to be rotatably connected with the blades, so that it increases attraction thereof.

1 Claim, 3 Drawing Sheets

PINWHEEL

BACKGROUND OF THE INVENTION

A pinwheel is a toy resembling a windmill, particularly one in which the blades or vanes are collapsible for storage or transpotation.

The conventional pinwheel consists of vanes of colored paper or plastic pinned to the end of a stick so that it turns as wind blowing.

Although the conventional pinwheel may satisfy the basic need, it has one or more of the following disadvantages:

1. Since it is not collapsible, storage or transportation is very difficult.
2. Due to its over simplified construction, the pinned connection for example is broken easy.
3. When lacking decoration it is less attactive to people.

SUMMARY OF THE INVENTION

The present invention utilizes a detachable cover having a plurality of pin members to be inserted into respective through holes defined on each blade of pinwheel and encloses the cover by a sleeve with a flange portion to confine said blades positioned on said cover. It further utilizes a decoration mounted on stick which is conventionally to be rotatably connected with blades, so that it increases attraction to people.

Therefore, it is an objective of the present invention to resolve the problems set forth above.

It is still an objective of the present invention to provide a pinwheel utilizing a detachable cover incorporated with a sleeve to confine blades thereof.

It is further an objective of the present invention to provide a decoration to increase attraction thereof.

Other objectives and advantages will be appreciated as the invention becomes better understood by reference to the following description considered in connection with the accompanying drawings.

DETAILED DESCRIPTION OF THE INVENTION

Figure 1:
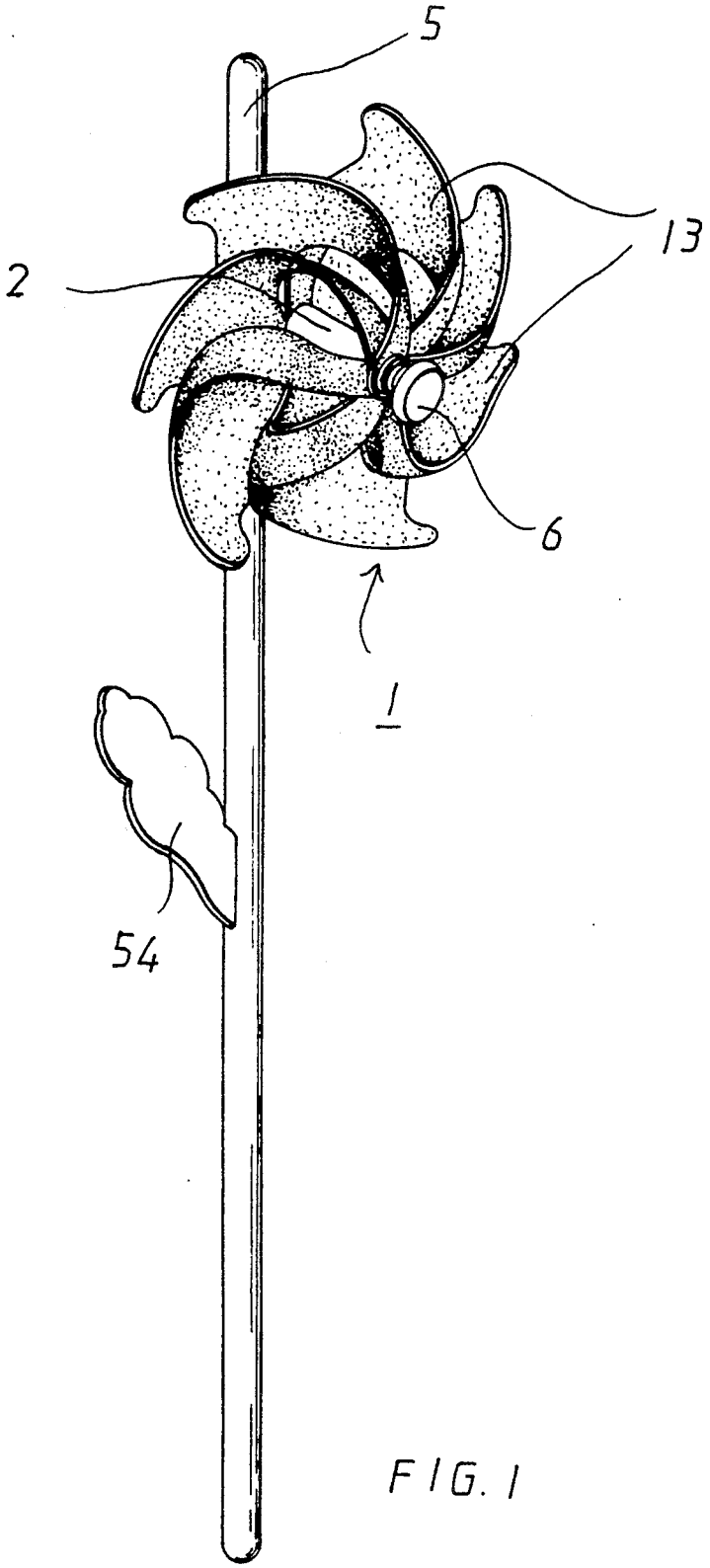
FIG. 1 is a perspective view according to the present invention.
Figure 2:
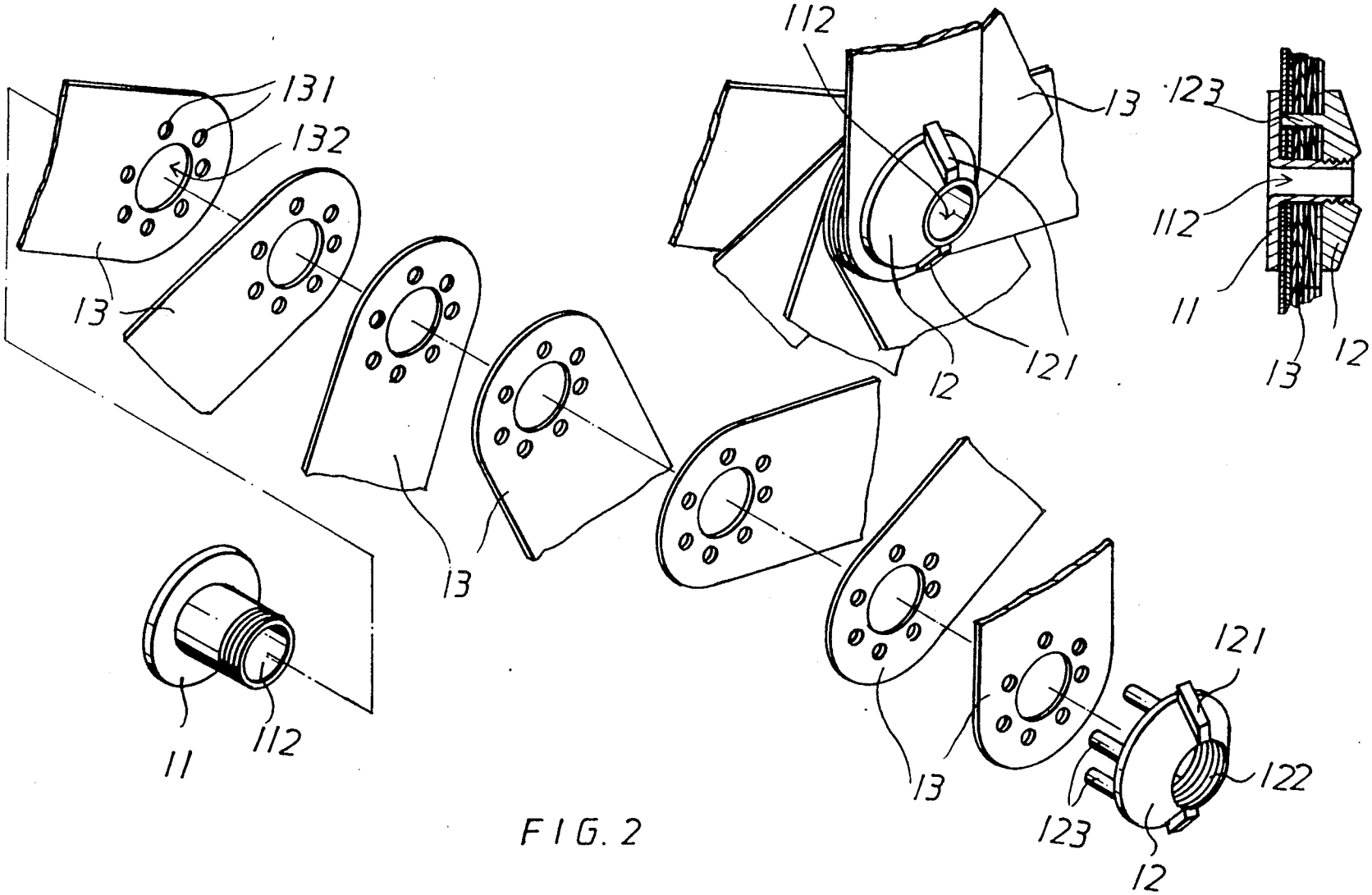
FIG. 2 is showing blade assembly according to the present invention.
Figure 3:
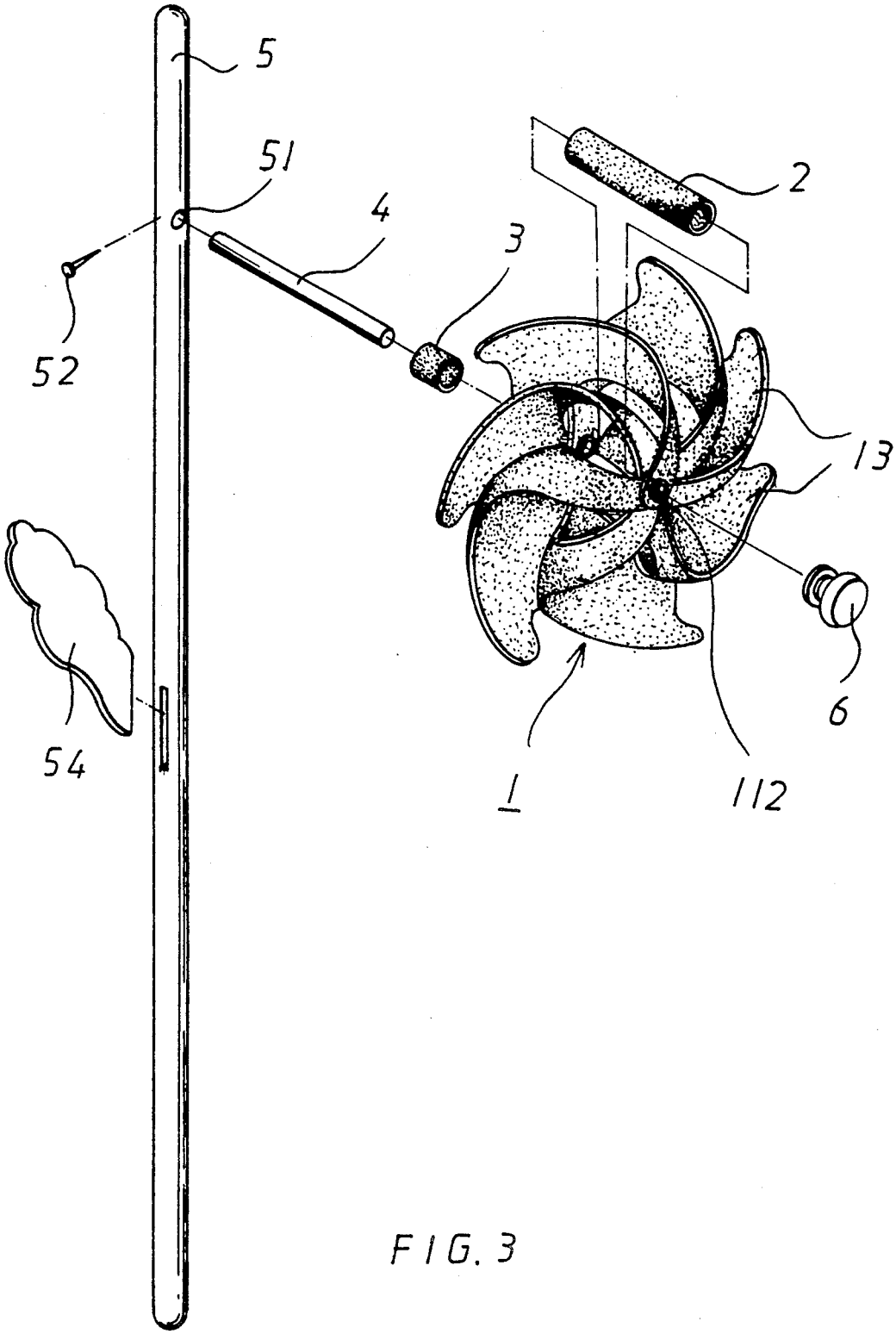
FIG. 3 is showing the assembly of the present invention.

With reference to FIGS. 1 to 3, the novel pinwheel generally comprises a blade assembly 1, defining a through hole 112 through which a hollow shaft 2 is inserted; a pin 4, further inserted through said hollow shaft 2 while pivotedly connecting to stick 5 through hole 51 by a screw 52 at one end to ensure the rotation of said blade assembly about pin 4; a sleeve 3, being of a hollow shape, positioned between said blade assembly and said stick 5 on said pin 4 to avoid direct contact of blade assembly and stick; an end plug 6, having a through hole defining at end portion to receive the other end of said pin 4; and a piece of decoration 54 mounted on suitable place of stick 5 adapted for better viewing.

The blade assembly 1 further comprises, as shown in FIG. 2, a plurality of blades 13 formed in such a way that they turn when blown upon; a plurality of relatively small, radically formed through holes 131 and larger through hole 132 defined on said blades; a cover 12, having a plurality of short pins 123, being identical numbers to through holes 131 and inserted thereto, a pair of projections 121 formed on the side opposite to said short pin adapted for the operation of fingers and a threaded hole 122; a sleeve 11 with flange portion at one end to confine the position of said blades as in assembly, and through hole 112 to substantially receiving pin 4 and threaded portion formed on outer parameter thereof; so that each said blade may be positioned on said sleeve 11 by inserting said larger through hole 132 into said sleeve 11 and inserting said short pins of said cover into respective said smaller through holes 131 and further threadedly secured by turning said projections.

It is apparent that as wind blowing, the blades of said blade assembly will be forced to rotate about said pin against said stick; Therefore, no further discussion is given for clarity.

What is claimed is:

1. A collapsible pinwheel, comprising, a plurality of blades, a large through hole defined on a first end of each of said plurality of blades, a plurality of smaller through holes formed around each of said large through holes, an outer cover for connecting said first end of each of said plurality of blades to each other, said cover having a plurality of inwardly directed short pins engaged to said plurality of smaller through holes, said cover having a threaded through hole coaxial to said large through hole, a pair of projections formed on said outer cover on a front side opposite to said short pins, a first sleeve having an outer diameter corresponding to a diameter of said large through hole, said first sleeve having an outwardly directed flange portion at a first end, a threaded portion engaged to said cover at a second end and a through hole coaxial to said large through hole, wherein, said first end of each of said plurality of blades is secured on said short pins between said flange of said first sleeve and said outer cover, said pinwheel further comprising, a stick for holding said plurality of blades, a first end of a pin removably connected to said stick, a hole on a second end of each of said plurality of blades having a diameter greater than a diameter of said pin, a second sleeve inserted in said through hole of said first sleeve, a third sleeve slideably mounted on said pin adjacent to said stick, an end plug removably connectable to a second end of said pin, wherein, said plurality of blades is rotatably mounted on said pin adjacent to said third sleeve by sliding said hole on each of said second end of said plurality of blades and said second sleeve onto said pin and connecting said end plug to said second end of said pin.

* * * * *